US005933980A

United States Patent [19]

Deshpande et al.

[11] Patent Number: 5,933,980

[45] Date of Patent: Aug. 10, 1999

[54] METHOD FOR CONTROLLING CURL WITH DRYER AIRCAPS

[75] Inventors: Rajendra D. Deshpande, Rockton; Jeffrey H. Pulkowski, Roscoe, both of Ill.

[73] Assignee: Beloit Technologies, Inc., Wilmington, Del.

[21] Appl. No.: 09/228,150

[22] Filed: Jan. 11, 1999

Related U.S. Application Data

[60] Division of application No. 08/657,754, May 30, 1996, which is a continuation-in-part of application No. 08/527,048, Sep. 12, 1995, Pat. No. 5,600,898.

[51] Int. Cl.[6] ..... F26B 3/00

[52] U.S. Cl. ..... 34/446; 34/454; 34/461; 34/116

[58] Field of Search ..... 34/114, 115, 116, 34/117, 120, 122, 123, 446, 454, 456, 461, 462, 464, 465

[56] References Cited

U.S. PATENT DOCUMENTS

| | | | |
|---|---|---|---|
| 3,134,653 | 5/1964 | Justus et al. | 34/114 |
| 5,152,076 | 10/1992 | Virta et al. | 34/417 |
| 5,311,672 | 5/1994 | Kotitschke et al. | 34/117 |
| 5,495,679 | 3/1996 | Deshpande et al. | 34/117 |
| 5,522,151 | 6/1996 | Deshpande et al. | 34/114 |
| 5,553,392 | 9/1996 | Hanaya | 34/115 |
| 5,600,898 | 2/1997 | Deshpande et al. | 34/116 |
| 5,630,285 | 5/1997 | Kerttula et al. | 34/446 |
| 5,647,141 | 7/1997 | Hanaya | 34/115 |

*Primary Examiner*—Henry Bennett
*Assistant Examiner*—Pamela A. Wilson
*Attorney, Agent, or Firm*—Lathrop & Clark LLP

[57] ABSTRACT

The dryer section in a papermaking machine has a single tier of all top felted dryer rolls six to nine feet in diameter. Air caps are employed over the dryer rolls to simultaneously dry both sides of the web to prevent curl and to increase drying rates. The air caps employ blown air at a temperature of 250–900 degrees Fahrenheit and air speeds of 8,000–40,000 feet per minute. The dryer fabric employed is foraminous with a permeability of between 300–1,200 cubic feet per minute per square foot and is designed to withstand peak temperatures of up to 900 degrees Fahrenheit and average temperatures of between 500–600 degrees Fahrenheit. A single transfer roll, or more advantageously, two grooved vacuum rolls in a vacuum box are disposed between the dryer rolls to maximize the circumferential wrap of the web and, at the same time, support and transport the web between dryer rolls.

3 Claims, 4 Drawing Sheets

METHOD FOR CONTROLLING CURL WITH DRYER AIRCAPS

CROSS REFERENCES TO RELATED APPLICATIONS

This application is a divisional of application Ser. No. 08/657,754, filed May 30, 1996, which is a continuation-in-part of application Ser. No. 08/527,048, filed Sep. 12, 1995, now U.S. Pat. No. 5,600,898.

STATEMENT AS TO RIGHTS TO INVENTIONS MADE UNDER FEDERALLY SPONSORED RESEARCH AND DEVELOPMENT

BACKGROUND OF THE INVENTION

This invention relates to dryers used in papermaking in general. More particularly, this invention relates to dryers of the single tier type.

Paper is made by forming a mat of fibers, normally wood fibers, on a moving wire screen. The fibers are in a dilution with water constituting more than ninety-nine percent of the mix. As the paper web leaves the forming screen, it may be still over eighty percent water. The paper web travels from the forming or wet end of the papermaking machine and enters a pressing section where, with the web supported on a dryer fabric, the moisture content of the paper is reduced by pressing the web to a fiber content of between forty-two and forty-five percent. After the pressing section, the paper web is dried on a large number of steam heated dryer rolls, so the moisture content of the paper is reduced to about five percent.

The dryer section makes up a considerable part of the length of a papermaking machine. The web as it travels from the forming end to the take-up roll may extend a quarter of a mile in length. A major fraction of this length is taken up in the dryer section. As the paper industry has moved to higher web speeds, upwards of four- to five-thousand feet per minute, the dryer section has had to become proportionately longer because less drying is accomplished at each dryer as the paper moves more quickly through the dryers.

One type of dryer, known as a two-tier dryer, has two rows of steam heated dryer rolls four to seven feet in diameter. The dryer rolls in the upper and lower rows are staggered. The paper web runs in a meandering fashion from an upper dryer roll to a lower dryer roll and then on to an upper roll over as many rolls as is required. An upper dryer fabric backs the web as it travels over the upper dryer rolls, and leaves the paper web as it travels to the lower rolls. The upper dryer fabric is turned by dryer fabric reversing rolls spaced between the upper rolls. On the lower dryer rolls the web is supported by a lower dryer fabric, which is also turned between lower dryer rolls by lower dryer fabric reversing rolls. This apparatus advantageously dries first one side and then the other of the web, however, the paper web is unsupported for a length as it passes from the upper dryer rolls to the lower dryer rolls, and from the lower rolls to the upper rolls. Unsupported paper webs present a problem as web speed increases. At higher web speeds, the paper interacts with the air and can begin to flutter. This fluttering can wrinkle and crease the paper web, seriously damaging the quality of the paper produced. Further, the fluttering can lead to tears and web failure, with all the cost and downtime associated with paper lost during the rethreading operation.

A first approach to overcoming this problem was to use a single dryer fabric or a wire which traveled with the paper web over both the upper and lower dryers so that the paper was supported through the open draws. This approach limited paper flutter in the open draws, but, because the blanket was disposed between the paper web to be dried and the lower dryer rolls, the effectiveness of the lower dryer rolls was substantially diminished.

A further dryer development is the single tier of dryer rolls with vacuum reversing rolls disposed therebetween. The vacuum rolls, such as those shown in U.S. Pat. No. 4,882,854 (Wedel, et al.), use vacuum to clamp the edges of the paper to the reversing roll to prevent edge flutter, and use central grooves to allow passage of the trapped boundary layer between the blanket and the reversing rolls.

Single tier dryer systems are successful in increasing the drying rate and shortening the dryer section of a papermaking machine. It is necessary in order to dry both sides of the web effectively to employ both top felted and bottom felted single tiers of dryers. Bottom felted dryers have the disadvantage in that removing broke from between the dryer fabric and the dryer can be a difficult and time consuming operation. On the other hand, in the top felted dryers, when the dryer fabrics are loosened, broke drops with relative ease out from between the dryer fabric and the dryer rolls. A further possible problem with single tier dryers is the sequential drying of first one side and then the other. When both sides of the sheet are not dried simultaneously curl can develop in the paper due to the effect of drying on the dimensions of the fibers on one side of the sheet as opposed to the still wet fibers on the other which can produce a tendency for the paper web to curl both in the cross machine and in the machine direction.

Problems with curling of the paper web as it moves through the dryer section also arise from the known tendency of a paper web to dry more rapidly at the edges as opposed to the center of the web. This problem of varying moisture profile in a drying paper web has in the past been dealt with by providing additional drying to the center of the web by for example using infrared radiators divided into zones. Alternatively, the edges of the paper have been sprayed with water to increase the moisture content of the edges to that of the center of the web. Another approach is the placement of a steam box which extends across the width of paper web and is connected to a source of steam for applying the width of paper web and is connected to a source of steam for applying steam to the web to equalize the properties of the web.

When a papermaking machine dries a web unevenly in the cross machine direction the paper shrinks more at the dyer edges, producing an uneven tension profile which can contribute to a tendency for the web to curl when formed into sheets. Curling of paper is a highly undesirable property particularly in fine paper which is used with new printing and copying methods. Laser printers and photo copiers heat the paper rapidly from a single side. If this heating produces curl in the paper a paper jam may result when the paper is attempted to be fed by the printer or photo copier machine.

What is needed is a shorter dyer section which dries both sides of the web simultaneously and actively controls paper moisture profile in the cross machine direction.

SUMMARY OF THE INVENTION

The paper dryer section of this invention employs a single tier of all top felted dryers. The dryer rolls are preferably of increased diameter, 8–20 feet in diameter, as opposed to the usual 6 foot diameter. The single tier arrangement, together with the top felting, assists in the removal of broke. Air caps are employed over the dryer rolls to simultaneously dry both sides of the web to prevent curl and to increase drying rates. The air caps employ blown air at a temperature of 200–900 degrees Fahrenheit and air speeds of 8,000–40,000 feet per minute. The dryer fabric employed is foraminous with a permeability of between 400–1200 cubic feet per minute per square foot and is designed to withstand peak temperatures of up to 900 degrees Fahrenheit and average temperatures of between 500–600 degrees Fahrenheit. Either one, or more advantageously, two vacuum rolls in a vacuum box are disposed between the dryer rolls to maximize the circumferential wrap of the web and, at the same time, support and transport the web between dryer rolls.

An alternative dryer section employs single tier top felted dryer rolls in combination with single tier bottom felted dryers. Air caps are positioned over or under the single tier dryer. The alternative dryer section may further employ air caps which are segmented in the cross machine direction. The segmented air caps allow cross machine profiling of the amount and temperature of the air applied to the web through the dryer fabric to achieve uniform cross machine direction moisture content. A beta sensor is used to detect moisture content of the web as the web leaves the dryer section. A controller utilizes the moisture profile generated by the beta sensor to control the amount of drying each cross machine direction portion of the web receives.

It is a feature of the present invention to provide a papermaking dryer apparatus which provides an increased rate of drying of a paper web.

It is another feature of the present invention to provide a more compact papermaking dryer section.

It is a further feature of the present invention to provide a papermaking dryer which prevents the formation of curl in the paper web being dried.

It is an additional feature of the present invention to provide a dryer section which actively controls the cross machine direction moisture content of the paper web.

It is yet another feature of the present invention to provide a dryer section of a papermaking machine which controls curl and maximizes onesideness of the paper formed.

Further objects, features and advantages of the invention will be apparent from the following detailed description when taken in conjunction with the accompanying drawings.

DESCRIPTION OF THE PREFERRED EMBODIMENTS

Figure 1:
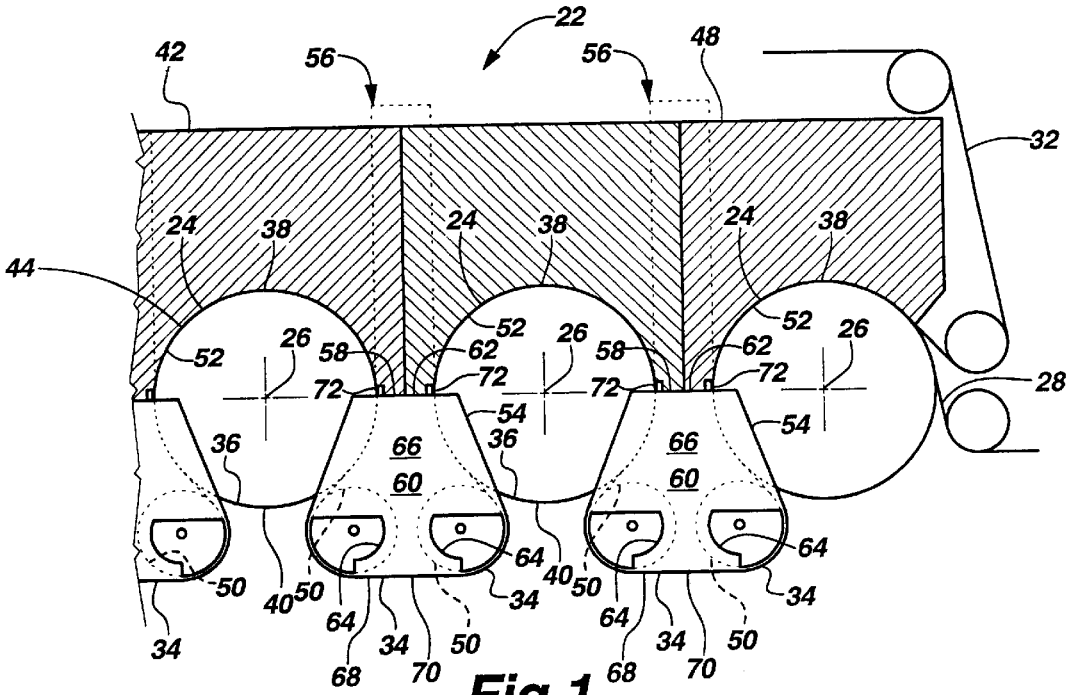
FIG. 1 is a schematic side elevational view of the dryer section of this invention employing two reversing rolls.
Figure 2:
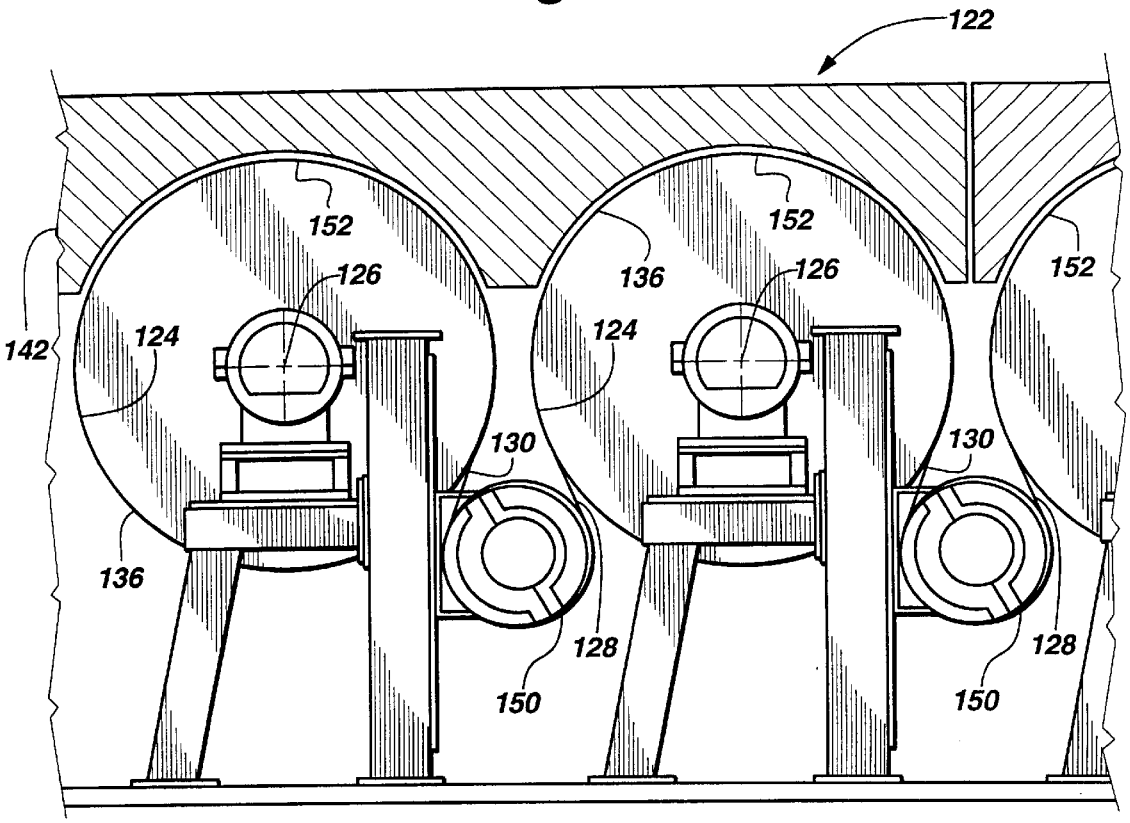
FIG. 2 is a somewhat schematic side elevational view of the dryer section of this invention employing a single reversing roll.
Figure 3A:
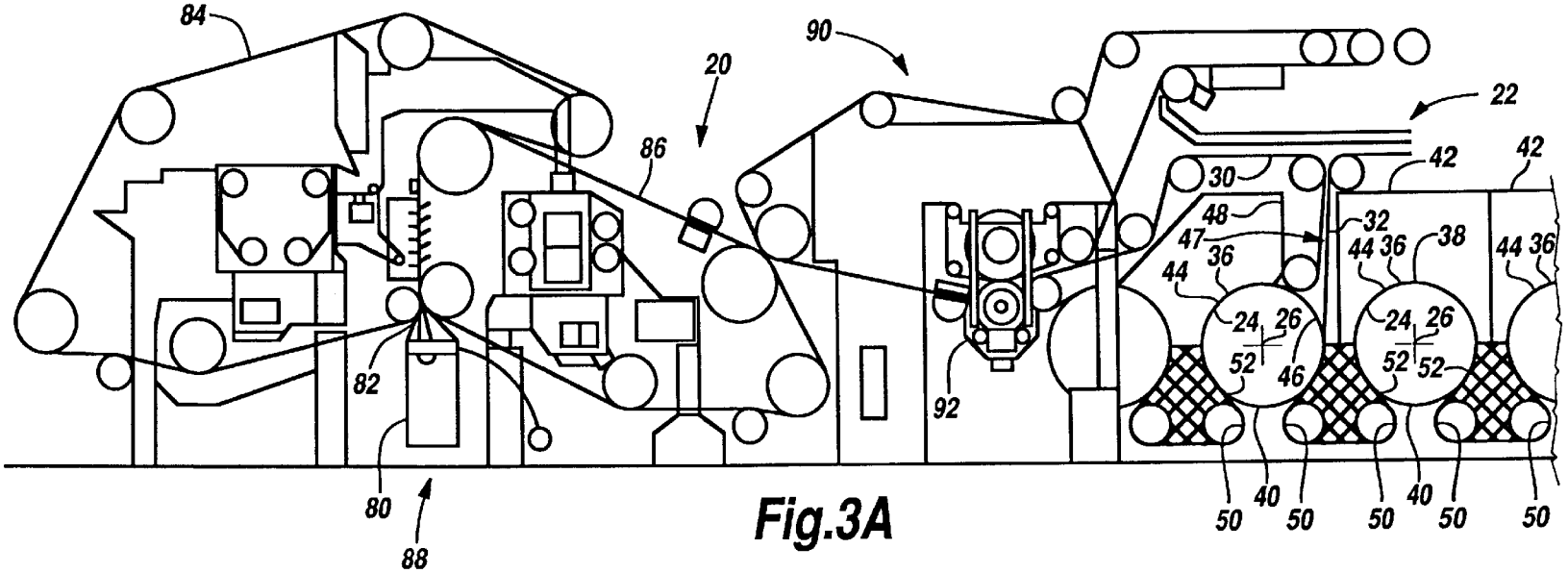
FIGS. 3A and 3B comprise a schematic view of a papermaking machine employing the dryer section of FIG. 1.
Figure 3B:
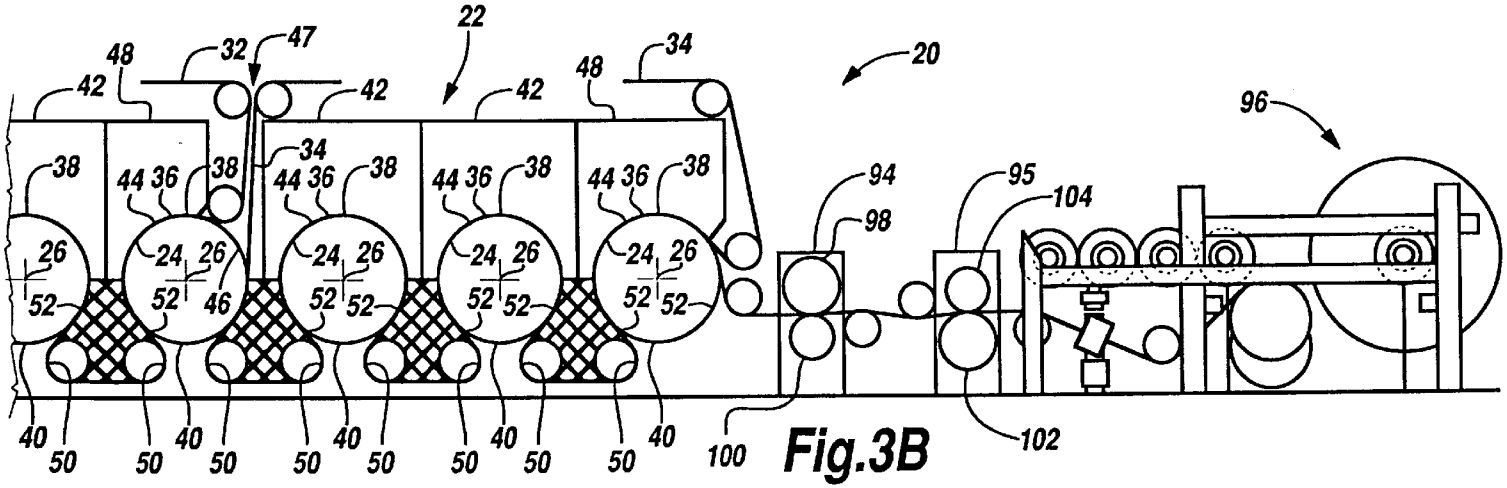

Referring more particularly to FIGS. 1–5 wherein like numbers refer to similar parts, a papermaking machine 20 is illustrated in FIGS. 3A–3B. The papermaking machine employs a dryer section 22. The dryer section is composed of dryer rolls 24 which are internally steam heated and will preferably have a diameter of eight to as large as twenty feet as opposed to conventional dryer rolls of six feet in diameter. The dryer rolls rotate about axes 26, the axes lying substantially in a single plane. Such an arrangement of dryer rolls is known as a single tier dryer section.

As shown in FIGS. 3A and 3B, a paper web 28 is wrapped onto the dryer rolls 24 by first a first dryer fabric 30, then a second dryer fabric 32, and finally a third dryer fabric 34 in sequence, as the paper web moves through the dryer section 22. Each dryer roll 24 has a dryer surface 36. The dryer roll surface 36 defines a cylinder, and thus the dryer roll has a circular cross-section. The circular cross-section has an uppermost or zenith point 38 and a lowermost or nadir point 40 at the bottom of each dryer roll 24. The dryer fabrics 30, 32, 34 wrap the dryer rolls 24 so the tops or zenith points 38 of the rolls are covered but the nadir 40 or bottom of the rolls are not overwrapped. This application of the dryer fabrics is referred to as top felting.

A top felted dryer section 22 has an advantage over bottom felted dryer systems in which the dryer fabrics wrap the bottom or nadir points of the dryer rolls, in that broke may much more easily be cleared from a top felted dryer section should a web break occur.

A papermaking machine 20 such as illustrated in FIGS. 3A–3B can operate in the range of 6,500 feet per minute. Paper breaks, while being highly undesirable on papermaking machines, are an inevitable occurrence particularly when the machine is changing between various grades of paper or when extensive maintenance and dryer fabric changes have been made. The high speed of the papermaking machine leads to an accumulation of a considerable quantity of broke or paper within the papermaking machine when a break occurs before the break can be detected and the machine shut down. The result is that the broken paper web will often wrap around individual dryer rolls. With top felting, the dryer fabrics can be slacked off from the dryer rolls 24 and any accumulated paper readily removed from and dropped down from the dryer rolls. This is in contrast to bottom felted single tier dryers where it is necessary to fish the broke out from between the dryer fabric and the dryer rolls, the dryer fabrics forming pockets about the dryer rolls which can accumulate and retain broken paper.

The disadvantage of single tier top felted dryers is that typically the paper web is dried from only a single side. This unidirectional drying of the paper web results in dimensional changes between the dryer side and the dryer fabric side of the web which, in turn, results in a permanent set or curling in the paper web which is an undesirable result. The dryer section 22 overcomes this problem by employing air caps 42 to dry the dryer fabric side of the web. The air caps 42 are hoods which overlie the upper portions 44 of the dryer rolls 24 and blow high velocity hot air through the dryer fabrics to dry the upper surface of the web simultaneously and preferably at the same rate as the roll side of the paper is dried by the steam heat transmitted to the surface 36 of the dryer rolls 24.

In order to allow the passage of air through the dryer fabrics 30, 32, 34 the dryer fabrics must be of a porous or foraminous nature. Thus, the dryer fabrics employed in the dryer section 22 will have a porosity in the range of four-hundred to twelve-hundred cubic feet per minute per square foot at one-half inches of water as typically measured by those skilled in the art of the design and construction of papermaking dryer fabrics. The air supplied by the air caps 42 may have a temperature range of two-hundred-and-fifty to nine-hundred degrees Fahrenheit and be blown at a velocity of between eight-thousand and forty-thousand feet per minute. The high air temperatures require dryer fabrics which can withstand up to nine-hundred degrees Fahrenheit for brief periods of time and steady state temperatures in the range of five-hundred to six-hundred degrees Fahrenheit.

Dryer fabrics of this nature may be constructed of metal, high temperature plastics such as polyetheretherketone (PEEK), or polyphenylene Sulfide (PPS) also sold as Ryton® fibers and manufactured by Phillips Petroleum Company, or other high temperature materials such as Nomex® fiber produced by E. I. Du Pont de Nemours Corporation, 1007 Market St., Wilmington Del., which can be formed into the necessary fibers.

As shown in FIGS. 3A–3B, multiple dryer fabrics 30, 32, 34 are employed. An exemplary transfer system, is of the so-called lick-down web transfer wherein the paper web 28 is supported on the dryer roll unbacked by dryer fabric over a short region 46 as it transits between the first dryer fabric 30 and the second dryer fabric 32 or the second dryer fabric 32 and the third dryer fabric 34. The air caps 48 adjacent to the lick-down transfers 47 do not blow on the unbacked short region 46 so the unbacked web is not blown off the dryer roll surface 36.

The web 28 is transferred between the multiple dryer rolls 24 of the single tier. Because only a single tier of dryer rolls 24 is employed in the dryer section 22, reversing rolls 50 are used to transfer the paper web 28 from the surface 36 of one dryer roll 24 to the surface of an adjacent dryer roll. In order to maximize the amount of drying achieved per dryer roll 24 it is desirable that the web be wrapped about the maximum portion practical of the dryer surface 38 of each dryer roll. As shown in FIGS. 1 and 3A–3B the employment of two spaced apart reversing rolls 50 maximizes the portion 52 of the roll surface 36 which is wrapped by the dryer fabrics 30, 32, 34 and the web 28. The dryer fabrics wrap a portion 52 comprising approximately eighty percent of the dryer roll surface 36, corresponding to approximately 290 degrees of the roll surface.

As shown in FIG. 1, where dual reversing rolls 50 are employed it is desirable to support the web 28 as it moves around the reversing rolls 50 to prevent fluttering and thus paper breaks. A vacuum chamber 54 is formed by a rigid metal structure 58 located between gaps 56 between dryer rolls 24. The vacuum chamber 54 is formed by a metal cover 58 which is sealed against the moving dryer fabrics 30, 32, 34 to define an internal volume on which reduced pressure is drawn. The cover 58 is comprised of two side plates 60, one of which is shown in FIG. 1. The side plates 60 are joined along the top by a top plate 62. Each side plate 60 has two clearance openings 64 which are smaller in diameter than the reversing rolls 50. Although vacuum is preferably drawn on the vacuum box 54, a similar effect can be achieved with a blowing box. However, a blowing box produces less clamping effect as the pressure reductions obtainable by blowing boxes are limited.

The reversing rolls 50 preferably are formed with circumferential grooves which facilitate holding the paper web and the dryer fabrics to the reversing roll 50. The reversing rolls 50 are rotatably mounted within the vacuum chamber 54. The openings 64 provide clearance for the side wall extensions of the shafts (not shown) on which the rolls 50 are mounted. The side plates 60 oppose each other and are perpendicular to the central axes 26 of the dryer roll 24. A hole (not shown) is cut through the side plate 60 which allows for the drawing of a vacuum on the vacuum chamber 54 by an external vacuum means (not shown). Each side plate 60 has an upper segment 66 which extends above the grooved rolls 50 and a downwardly extending tab 68 which blocks escaping air to the sides of the grooved rolls. A lower horizontal edge 70 of the tab 68 engages with the dryer fabric 30, 32, 34 as it passes between the two grooved rollers 50. Stiffening ribs (not shown) may project inwardly from the inner perimeter of the side plates 60 to prevent excessive deflection of the plates by the application of vacuum. Two inclined flanges 72 extend from the top plate 62 between the side plates 60. Each inclined flange 72 extends upward of the top plate 62 and inward towards the center of the top plate 60, thereby forming an acute angle with the top plate 62. The net result of the grooved rollers 50 and the vacuum box 54 is to restrain the web and the backing dryer fabric from fluttering as it transfers from one dryer roll to the next whilst preventing paper breaks.

As shown in FIG. 2, an alternative dryer section 122 employs dryer rolls 124 and air caps 142. The dryer section 124 is similar to the dryer section 24 of FIG. 1, except that only a single reversing roll 150 is employed to transfer the web 128 and dryer fabric 130 between dryer rolls 124. The result of employing a single reversing roll reduces the complexity of the dryer section 122. However, the use of a single reversing roll results in a wrapped portion 152 which is a somewhat smaller percentage of the total surface area 136 of the roll when compared to the wrapped percentage of the dryer section 22 of FIG. 1.

The reversing rolls 50 and 150 are preferably placed as close to the dryer rolls as possible to minimize the portion of the web which is not firmly clamped to the dryer fabric or dryer surface. Constraining the web as it moves through a dryer section improves sheet properties. Shrinkage in the machine direction can be controlled by the tension in the web resulting from control of the dryer speeds. Shrinkage in the cross machine direction can only be controlled by clamping the web to the dryer surface with dryer fabric tension and holding the web on the dryer fabric as it moves around the reversing rolls with vacuum. Thus the importance of restraining the web as much as possible. Using dryer rolls of eight to twenty feet in diameter means that the tension in the dryer fabric must be increased if the clamping force on the dryer roll surface is to remain constant. Increasing dryer fabric tension increases the loads on the dryer rolls, the reversing rolls and other rolls which handle the dryer fabrics, which in turn requires increased roll stiffness and roll bearings of greater strength. For example, the tension applied to the dryer fabric is between about ten and about twenty pounds per linear inch for a six foot diameter dryer and which the tension is increased proportional to the dryer diameter up to a diameter of twenty feet.

The reversing rolls 50 and 150 however can not be too close to the dryer rolls because in the event of a paper break the web can become wrapped around a dryer which will then destructively engage an adjacent reversing roll. In practice the minimum spaces between the reversing rolls and the dryer rolls depends on the paper thickness being made, the speed with which a paper break is automatically detected and the web is diverted from the dryer section, and whether or not the reversing rolls are mounted to pivot away from the dryer rolls. The usual result is that the reversing rolls are placed one to five inches away from the dryer rolls with the choice in a particular situation being up to the paper mill operator.

An exemplary paper machine 20 employing the dryer section 22 is shown in FIGS. 3A–3B. The papermaking machine 20 illustrated can be used to produce twenty-eight pound newsprint with a wire width of four-hundred-and-twenty inches and operating at a speed of sixty-five-hundred feet-per-minute. The papermaking machine 20 employs a former 88 which has a vertically oriented headbox 80 which has a slice opening 82 which injects a stream of pulp between a first forming wire 84 and a second forming wire 86 which comprises the twin wire former 88. The paper web 28 is transferred to a press section 90 where a single extended nip press 92 accomplishes the pressing function. The web 28 is then wrapped onto the first dryer fabric 30 and transferred to the dryer section 22. After transiting the dryer section 22 the web is calendered with high temperature soft nip calenders 94 and 95. Following calendering the web is wound onto reels by a winder 96.

The soft nip calender 94 has an upper heated press roll 98 and a lower compliant backing roll 100. The calender 94 is of the temperature gradient type where the web is not preheated and thus only the surface in contact with the heated roll is deformed in passing through the calender 94. The second soft nip calender 95 has a lower heated press roll 102 and an upper backing roll 104. The heated press rolls 98 and 102 engage opposite sides of the web 28. Thus by varying the temperature of the upper heated press roll 98 versus the temperature at the lower heated press roll, and by varying the pressing pressure in the first calender 94 versus the pressure in the second calender 95, the surfaces of the web 28 can be treated differently to compensate for twosidedness produced by the dryer section 22.

One preferred system will employ components manufactured by Beloit Corporation of Beloit, Wis. The twin wire former may be a Bel-Bai RCB type enclosed jet former obtainable from Beloit Corporation. The headbox used will preferably be the concept IV-MH headbox employing consistency profiling, also available from Beloit Corporation. Press sections, high temperature soft nip calenders and reels are also available from Beloit Corporation.

The papermaking machine 22 employing the dryer section 24 may be observed to be of compact design with relatively few dryer rolls as well as few rolls of any type. Because of the high cost of individual rolls, together with their bearings and support system, a papermaking machine such as the one illustrated in FIGS. 3A–3B contributes to improved cost, reliability, and performance.

Figure 4A:
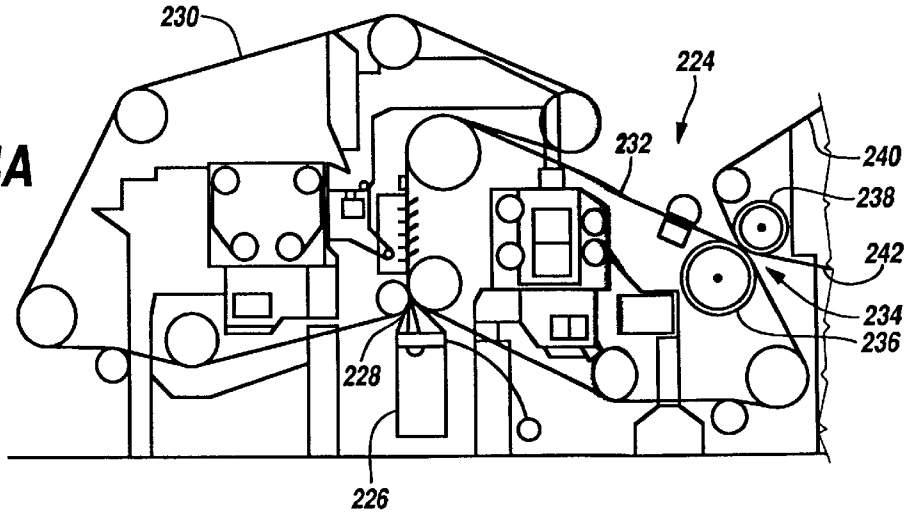
FIGS. 4A and 4B comprise a schematic view of an alternative embodiment papermaking machine with dryer section of this invention.
Figure 4B:
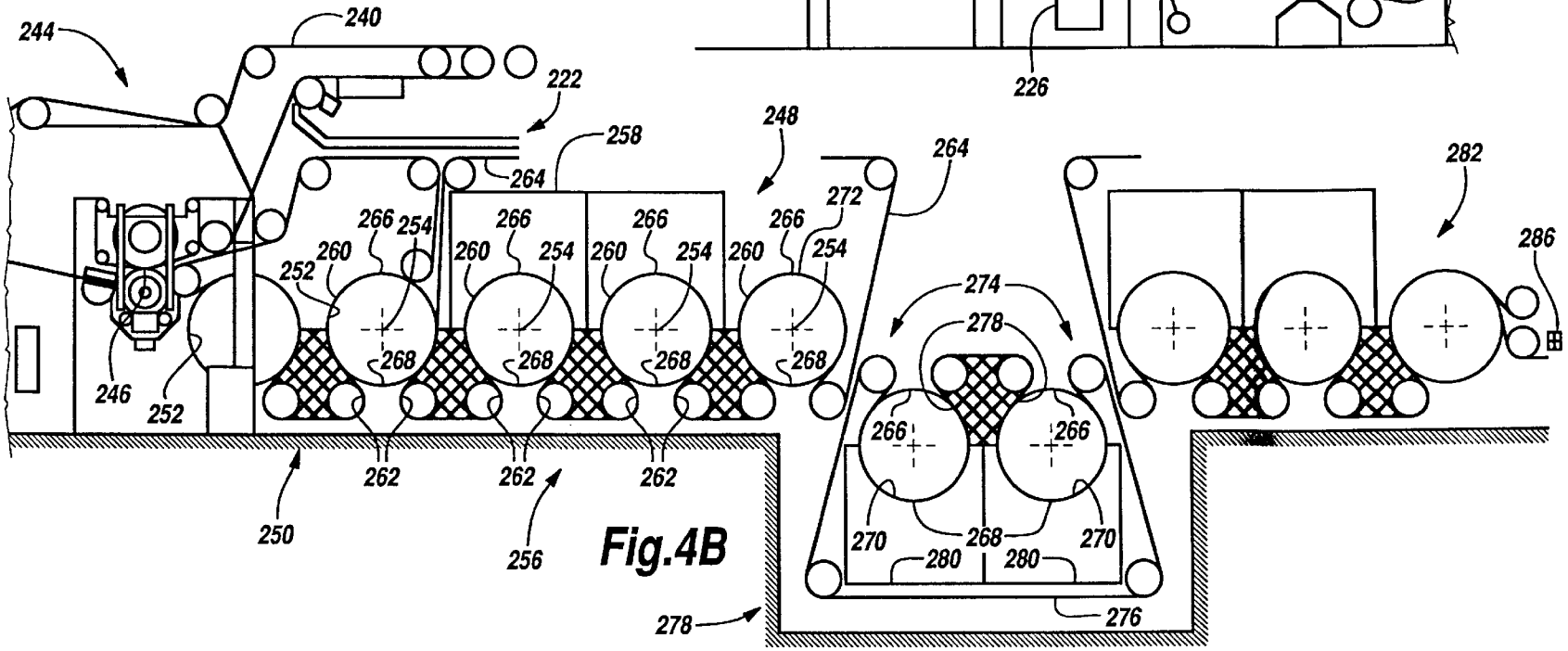

An alternative embodiment papermaking machine 220 with dryer section 222 is shown in FIGS. 4A and 4B. The papermaking machine 220 has a former 224 which is similar to the former 88. The former 224 has a headbox 226 with a slice 228 which directs a stream of stock between a first wire 230 and a second wire 232. A lumpbreaker press 234 is formed of a lower press roll 236 and an upper backing roll 238. The lower press roll 236 is contained within a loop formed by the second wire 232.

The upper backing roll 238 is contained within a loop formed by the press felt 240. Utilization of a lumpbreaker press 234 increases the fiber content of a web 242 formed by the former 224 from sixteen percent dry weight to about twenty-two percent dry weight. The lumpbreaker press 234 can be positioned before the press felt 240 engages the second forming wire 232. This has the advantage of minimizing the amount of water pressed into the press felt 240. The lower press roll 236 and the upper backing roll 238 will preferably have elastic coverings to minimize the impression on the web formed by the forming wire 224.

A pressing section 244 employing a single concave shoe press 246 such as an Extended Nip® type press manufactured by Beloit Corporation, follows the former 224. The dryer section 248 shown in FIG. 4B is a variation on the dryer section 22. The dryer section 248 employs single tier dryers. However the first fabric group 250 is without air caps and is typical of a variation on dryer section 22 necessitated by retrofitting air caps onto a existing machine where space limitations may dictate leaving air caps off the dryer rolls adjacent to the pressing section. Further the first fabric group of dryer rolls 250 as shown in FIG. 4B contains fewer dryer rolls and thus the lack of air caps is less critical on the shorter dryer section. The first fabric group of dryer rolls employs dryer rolls 252 which rotate about axes 254.

A "fabric group" of dryer rolls is defined as a group of dryer rolls substantially in a single plane which are engaged by a single dryer fabric. The second fabric group of dryer rolls 256 employs air caps 258 over the tops of the dryer rolls 260. Reversing rolls 262 between each pair of dryer rolls 260 conduct the dryer fabric 264 with the paper web 242 clamped by vacuum drawn through the dryer fabric 264. Each dryer roll 260 has a zenith point 266 and a nadir point 268. The dryer rolls 260 are top felted in that the dryer fabric 264 wraps the tops of the dryer rolls including the zenith points 266 but not the nadir points 268. Although top felted dryer rolls are preferred because of their operational advantages in handling broke, in some circumstance it may be desirable to employ one or more bottom felted dryer rolls 270 in order to achieve better onesideness of the paper web 242.

The last dryer roll 272 in the fabric group 256 prior to the bottom-felted dryer rolls 270 is without an air cap because of space considerations, and leads into an S-web transfer 274 which is shown in FIG. 4B without the web 242 and with a small gap between the transfer dryer fabrics for clarity. The S-web transfer holds the web between the dryer top felt 264 and a bottom dryer felt 276. The S-web transfer provides a means for transferring the web from the first dryer section to the second dryer section in which the web 242 is transferred without an open draw from the top felted dryer fabric group 256 and to the fabric group of bottom felted dryer rolls 278. The S-web transfer defines a joint run of the dryer top dryer fabric 264 and the bottom dryer fabric 276 such that the web is conveyed by the top dryer fabric in close conformity with the bottom dryer fabric. Subsequently, the top dryer fabric diverges from the web and the web is carried by the bottom dryer fabric.

The bottom felted dryer rolls 270 in FIG. 4B are shown with air caps 280 but depending on the paper being dried could be used without air caps. The advantage of employing bottom felted dryer rolls 270 is their ability to improve onesideness of the web 242. This advantage offsets in some circumstances the problem associated with removing broke from bottom felted dryer rolls. An additional fabric group 282 of top felted dryer rolls following the bottom felted fabric group 278 may be utilized as required to achieve the desired dryness of the paper web 242.

Figure 5:
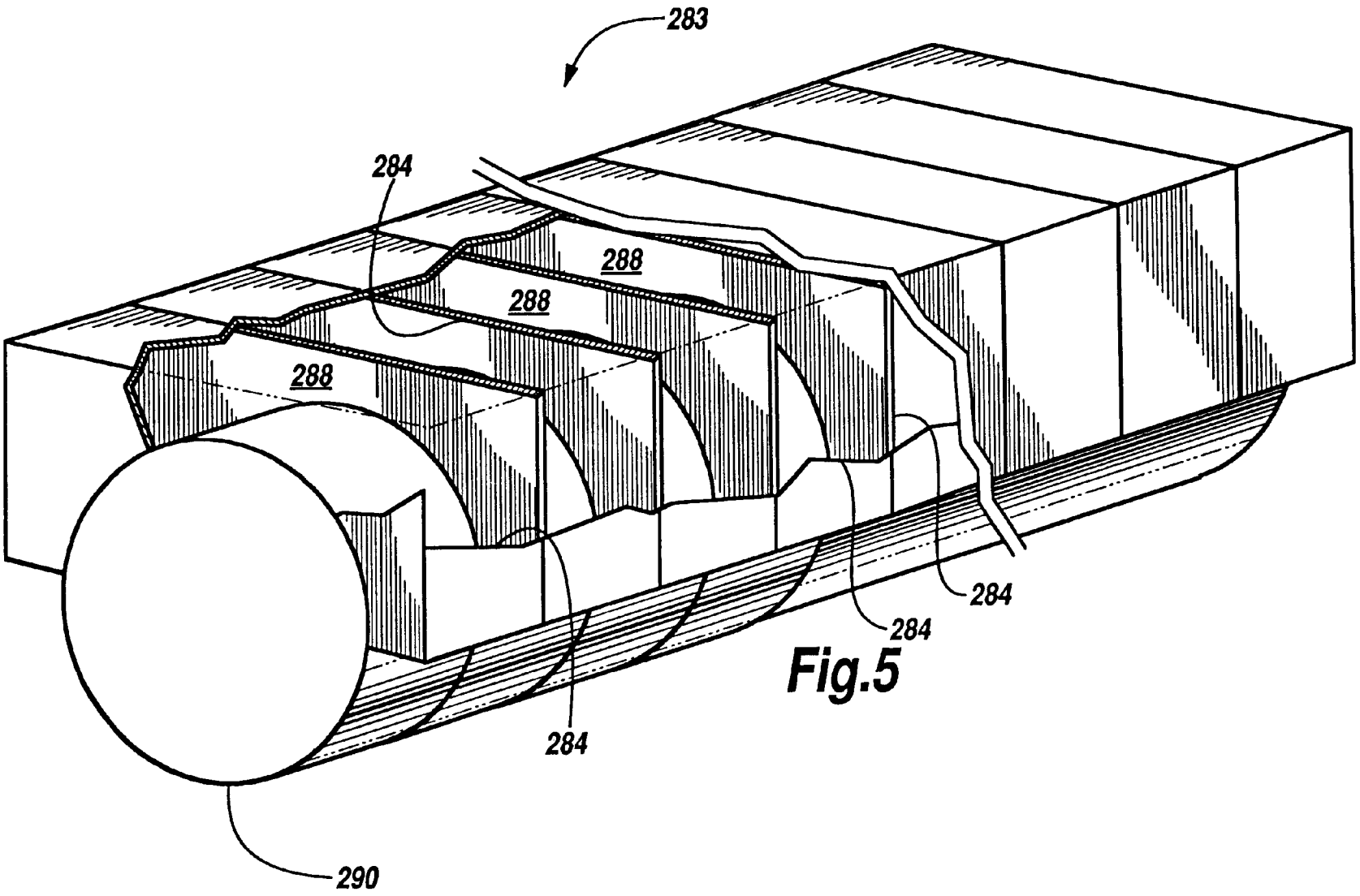
FIG. 5 is an isometric view, partially cut-away of a dryer air cap with multiple partitions in the cross machine direction.

One major problem in drying a paper web is the tendency for the web to dry more rapidly in some locations than in other locations in the cross machine direction. As shown in FIG. 5, an air cap 283 which is divided by baffles 288 into partitioned compartments 284 can be used to control web moisture content in the cross machine direction. A sensor 286 for measuring web moisture, shown schematically in FIG. 4B, is mounted to traverse the web and provide moisture profile data on the web as it is formed. A typical sensor utilizes beta radiation to monitor moisture content in the web.

A computer or controller (not shown) utilizes the output of the sensor to control air velocity and/or air temperature which is introduced into each partitioned compartment 284 of the air caps 283. The controller thus responds to the moisture profile in the treated web to adjust treatment of subsequent portions of the web. In practice air of a single temperature is directed into each partition 284 by a series of dampers (not shown) which control the amount of heating air supplied to each partitioned compartment 284 under the control of the computer or controller. The compartments 284 are formed by baffles 288 which divide the air cap 283 into regions in which the air flow can be separately controlled. The baffles 288 extend in the machine direction and the compartments 284 are aligned in the cross machine direction. Baffles 288 can be used together with moisture profiling with any of the air caps 258, 280, 42, 122 illustrated in FIGS. 1–4B. The air cap 283 is schematic to show the position of the air cap over a typical dryer roll 290. The additional ductwork and gas firing units are omitted for clarity.

It should be understood that the invention depicted in FIGS. 4A–4B would typically be constructed as a new papermaking machine, yet the embodiment as illustrated incorporates various structures which may be required in retrofitting an old machine. In particular, some of the dryer rolls as shown do not employ air caps, whereas preferably in an all newly constructed papermaking machine, where maximum drying capability is desired, each dryer roll would have an air cap. Where space limitations associated with dryer fabric transfers prevent a complete air cap from being positioned over the a dryer roll, partial air caps may be employed.

It should be understood that the air temperature used in the dryer air caps may be varied between the wet end and the dry end of the dryer with the higher temperature air being used at the wet end.

It should also be understood that an exemplary air velocity of twenty-eight-thousand feet per minute and an air temperature of seven-hundred-and-fifty degrees may be employed. In general the air temperature should be greater than two hundred and fifty degrees Fahrenheit with an air velocity of greater than twelve thousand feet per minute.

The permeability of the dryer fabrics, sometimes referred to in the trade as dryer felts or dryer canvas, should be greater than a typical dryer fabric which has a permeability of between ninety and one-hundred twenty cubic feet per minute per square foot at a pressure of one-half inches of water. Preferably the permeability of the dryer fabrics will be greater than two-hundred to three-hundred cubic feet per minute per square foot at a pressure of one-half inches of water. The preferred permeability is in the range of three-hundred to twelve-hundred cubic feet per minute per square foot at a pressure of one-half inches of water.

It should be understood that greater dryer surface for a given floorprint may be achieved by using larger dryer rolls and that dryer technology used in the manufacturer of Yankee dryers assures that dryer rolls as large as twenty feet can be constructed.

It should also be understood that a further advantage of the dryer section 22 of this invention is that when all the dryer rolls are in a single tier it is possible to mount the dryer section directly to the mill floor without the necessity of constructing basements under the dryer. This relatively simple and more rigid mounting is preferred.

It should also be understood that although three dryer fabrics are shown, more or fewer dryer fabrics could be used. The advantages of employing greater numbers of dryer fabrics are threefold. One, the paper lengthens and shortens slightly as the drying process is accomplished and therefore the dryer rolls are required to run more rapidly as the paper progresses through the dryer section 22. The more drying fabrics, the more stages in which the paper speed can be increased. Secondly, changing dryer fabrics prevents a single dryer fabric from impressing a pattern onto the surface of the web. Thirdly, it is to be understood that shorter dryer fabrics are more easily changed.

It is understood that the invention is not limited to the particular construction and arrangement of parts herein illustrated and described, but embraces such modified forms thereof as come within the scope of the following claims.

We claim:

1. A method of drying a paper web in a drying section of a papermaking machine comprising the steps of:

wrapping a paper web overlain by a foraminous dryer fabric having a porosity of between three and twelve-hundred cubic feet per minute per square foot at a pressure of one-half inches of water, about a portion of a plurality of dryer rolls arrayed in substantially a single plane, wherein each dryer roll defines an uppermost portion and a lowermost portion and wherein the web does not wrap any of the lowermost portion of any roll; and drying the web simultaneously on both sides by steam heating the dryer rolls and by blowing air at a temperature greater than two-hundred and fifty degrees Fahrenheit at a velocity of between eight thousand and forty thousand feet per minute through at least a portion of said foraminous dryer fabric where it overlies the paper web on the dryer roll surfaces.

2. The method of drying a paper web of claim 1 further comprising the step of applying a tension to the foraminous dryer fabric which is between about ten and about twenty pounds per linear inch for a six foot diameter dryer and which tension is increased proportional to the dryer diameter up to a diameter of twenty feet.

3. A method of drying a paper web on a papermaking machine comprising the steps of:

forming a web of paper and directing the web to a dryer section;

drying the web on steam heated dryer rolls while the web is constrained against the dryer rolls by a dryer fabric;

after the web has left the dryer section measuring the moisture profile of the web in a cross machine direction;

while drying the web blowing air onto the constrained web through the dryer fabric and adjusting the blowing air in a cross machine direction over the dryer rolls in response to the measured moisture profile of the web to improve the uniformity of moisture content across the web in the machine direction.

* * * * *